US006106247A

United States Patent [19]

Wood

[11] Patent Number: 6,106,247

[45] Date of Patent: Aug. 22, 2000

[54] SCROLL-TYPE FLUID DISPLACEMENT APPARATUS INCLUDING AN ECCENTRIC CRANK MECHANISM HAVING AN ELONGATED SHAFT

[75] Inventor: Stephen J. Wood, Oskosh, Wis.

[73] Assignee: Haldex Brake Corporation, Kansas City, Mo.

[21] Appl. No.: 09/040,801

[22] Filed: Mar. 18, 1998

[51] Int. Cl.[7] ..... F04B 17/00

[52] U.S. Cl. ..... 417/410.5; 418/55.3; 418/181

[58] Field of Search ..... 418/55.3, 181; 417/410.5

[56] References Cited

U.S. PATENT DOCUMENTS

| | | | |
|---|---|---|---|
| 3,802,809 | 4/1974 | Vulliez | 418/55.3 |
| 3,994,633 | 11/1976 | Shaffer | 418/5 |
| 3,994,636 | 11/1976 | McCullough et al. | 418/142 |
| 4,141,677 | 2/1979 | Weaver et al. | 418/6 |
| 4,157,234 | 6/1979 | Weaver et al. | 418/6 |
| 4,192,152 | 3/1980 | Armstrong et al. | 418/5 |
| 4,260,402 | 4/1981 | Shaffer et al. | 55/505 |
| 4,270,885 | 6/1981 | Shaffer et al. | 417/279 |
| 4,304,296 | 12/1981 | Shaffer | 165/125 |
| 4,382,754 | 5/1983 | Shaffer et al. | 418/83 |
| 4,561,834 | 12/1985 | Poss | 418/181 |
| 4,832,586 | 5/1989 | Emmenthal et al. | 418/55.3 |
| 4,990,072 | 2/1991 | Güttinger | 418/55.3 |
| 5,082,430 | 1/1992 | Güttinger | 418/55.2 |
| 5,145,344 | 9/1992 | Haga et al. | 418/55.3 |
| 5,154,592 | 10/1992 | Ohtani et al. | 418/55.3 |
| 5,165,878 | 11/1992 | Inagaki et al. | 418/55.3 |
| 5,466,134 | 11/1995 | Shaffer et al. | 418/55.3 |
| 5,556,269 | 9/1996 | Suzuki et al. | 418/55.3 |

*Primary Examiner*—John J. Vrablik
*Attorney, Agent, or Firm*—St. Onge Steward Johnston & Reens LLC

[57] ABSTRACT

A scroll-type fluid displacement apparatus including at least two scroll members, with each scroll member having a plate and spiral involute extending from the plate. The spiral involutes mesh to define fluid voids between the scroll members that become smaller towards the center of the scroll members. The apparatus also includes an eccentric crank mechanism having an elongated shaft with an eccentric portion. The elongated shaft is connected at one end to a motor and at another end to a machine, while the eccentric portion is rotatably received by one of the scroll members such that the scroll members will orbit with respect to one another as the shaft is turned by the motor. The apparatus also includes at least one eccentric guide for assisting the eccentric crank mechanism in retaining the scroll members in an orbiting relationship. According to one embodiment, the eccentric guide comprises a second eccentric crank mechanism having an elongated shaft with an eccentric portion rotatably received by one of the scroll members. According to another embodiment, the elongated shaft of the second eccentric crank mechanism is connected at one end to a motor and at another end to a machine.

18 Claims, 3 Drawing Sheets

SCROLL-TYPE FLUID DISPLACEMENT APPARATUS INCLUDING AN ECCENTRIC CRANK MECHANISM HAVING AN ELONGATED SHAFT

FIELD OF THE INVENTION

The present invention relates to scroll-type fluid displacement apparatus, such as compressors, vacuum pumps, air motors, expanders, and the like. More particularly, the present invention relates to a fluid displacement apparatus including an eccentric crank mechanism having an elongated shaft for extending between a motor and an auxiliary machine.

BACKGROUND OF THE INVENTION

Scroll-type fluid displacement apparatus, such as compressors, vacuum pumps, air motors, expanders, and the like are often used in equipment such as air brakes, air conditioners and refrigerators, for example, and are favored for such applications because they tend to be quieter in operation than reciprocating fluid displacement apparatus. Scroll compressors, in particular, normally include at least one fixed and one orbiting scroll member. Each scroll member has a scroll blade, involute or wrap meshed with the other's scroll blade to define suction areas or zones at the outer edges of the scroll members, fluid voids between the scroll members, and an outlet at the center of the scroll members.

Eccentric crank mechanisms are normally used to maintain the scroll members in a specific orbiting relationship with respect to one another. The crank mechanisms include a shaft rotatably mounted to a housing of the compressor, and an eccentric portion fixed to the shaft. As is known, the eccentric portion has an axis offset from an axis of the shaft. The orbiting scroll member is operatively connected to the crank mechanism through the eccentric portion, such that the orbiting scroll member will orbit, but not rotate with respect to the fixed scroll member, as the shaft and eccentric portion of the crank mechanism rotate.

Such eccentric crank mechanisms are shown, for example, in U.S. Pat. No. 4,192,152 to Armstrong et al. and U.S. Pat. No. 5,154,592 to Ohtani et al. A separate driveshaft is operatively connected to the orbiting scroll member and is turned by a motor to orbit the orbiting scroll member on the crank mechanisms, and about the fixed scroll member. As the orbiting scroll member orbits, the fluid voids between the scroll members become smaller towards the center of the scroll members and compress the fluid contained therein. The compressed fluid is then expelled under pressure from the outlet at the center of the scroll members.

In order to reduce the number of parts and complexity of a compressor, parts are preferably combined whenever possible. U.S. Pat. No. 5,165,878 to Inagaki et al. and U.S. Pat. No. 5,556,269 to Suzuki et al., for example, each disclose a scroll compressor including an eccentric crank mechanism having a shaft extending to a motor. In effect, therefore, the eccentric crank mechanism is combined with the driveshaft, such that the total number of parts and complexity of the compressor is reduced. Suzuki et al. also discloses an auxiliary driveshaft that is driven by the "main" driveshaft with a timing belt. Multiple driveshafts are sometimes preferable to more evenly distribute stresses within the compressor, and/or improve the efficiency of the compressor. Neither Inagaki et al. nor Suzuki et al., however, disclose or suggest means for harnessing excess power of the driveshaft for auxiliary machinery, such as a fan or another compressor stage for example.

Preferably, therefore, means are also provided for harnessing excess power of the compressor. U.S. Pat. No. 5,466,134 to Shaffer et al., for example, discloses a scroll compressor having a driveshaft and a separate, eccentric crank mechanism that is externally accessible so that the rotational motion of the eccentric crank mechanism may be harnessed to drive an auxiliary machine. A drawback of this design, however, is that the excess power isn't taken directly from the driveshaft but is transferred through the eccentric crank mechanism, which may result in an inefficient transfer of excess power to the auxiliary machine, and additionally stresses during operation of the compressor. These additional stresses may in turn require inefficient and expensive overbuilding of the crank mechanism, which may in-turn increase the temperature of, or hinder the cooling of the compressor during operation.

What is still needed and desired is a scroll-type fluid displacement apparatus having fewer parts, yet wherein excess power is accessible directly from the drive shaft. Also, the fluid displacement apparatus will desirably include multiple drive or input shafts so that stresses will be more evenly distributed within the apparatus. Furthermore, any eccentric crank mechanisms or drive shafts should be mounted or designed to provide adequate room for the use of strengthening and heat dissipating ribs.

SUMMARY OF THE INVENTION

An object of the present invention, accordingly, is to provide a scroll-type fluid displacement apparatus wherein excess power of a drive motor of the apparatus can be directly harnessed.

Another object of the present invention is to provide a scroll-type fluid displacement apparatus having fewer parts.

A further object of the present invention is to provide a less complex scroll-type fluid displacement apparatus.

An additional object of the present invention is to provide more flexible and more efficient packaging for a scroll-type fluid displacement apparatus.

A further object of the present invention is to provide a scroll-type fluid displacement apparatus having scroll members with improved strengthening and/or heat dissipating ribs.

Another object of the present invention is to provide a scroll-type fluid displacement apparatus wherein stresses within the apparatus are more evenly distributed.

These and other objects of the present invention are achieved by a scroll-type fluid displacement apparatus including at least two scroll members, with each scroll member having a plate and a spiral involute extending from the plate. The spiral involutes mesh to define fluid voids between the scroll members that become smaller towards the center of the scroll members. The apparatus also includes an eccentric crank mechanism having an elongated shaft with an eccentric portion. The elongated shaft is connectable at one end to a motor and at another end to an auxiliary machine, while the eccentric portion is rotatably received by one of the scroll members such that the scroll members will orbit with respect to one another as the shaft is turned by the motor. The apparatus also includes at least one eccentric guide for assisting the eccentric crank mechanism in retaining the scroll members in an orbiting relationship.

In effect, therefore, the present invention provides a scroll-type fluid displacement apparatus wherein a drive shaft and an eccentric crank mechanism are combined to produce a more efficient, less complex, scroll-type fluid displacement apparatus having fewer parts. In addition, since the shaft includes a second end for connection to an auxiliary machine, excess power from the apparatus can be directly harnessed.

According to one aspect of the present invention, the eccentric guide comprises a second eccentric crank mechanism having an elongated shaft with an eccentric portion rotatably received by one of the scroll members. The elongated shaft of the second eccentric crank mechanism is connectable at one end to a motor, whereby stresses in the apparatus are more evenly distributed.

According to another aspect of the present invention, the eccentric crank mechanisms are positioned at outer peripheries of the scroll members, wherein each scroll member can be provided with ribs extending from the plate on a side opposite the involute for strengthening the scroll members and providing heat dissipation.

The invention and its particular features and advantages will become more apparent from the following detailed description considered with reference to the accompanying drawings.

DETAILED DESCRIPTION OF THE INVENTION

Figure 1:
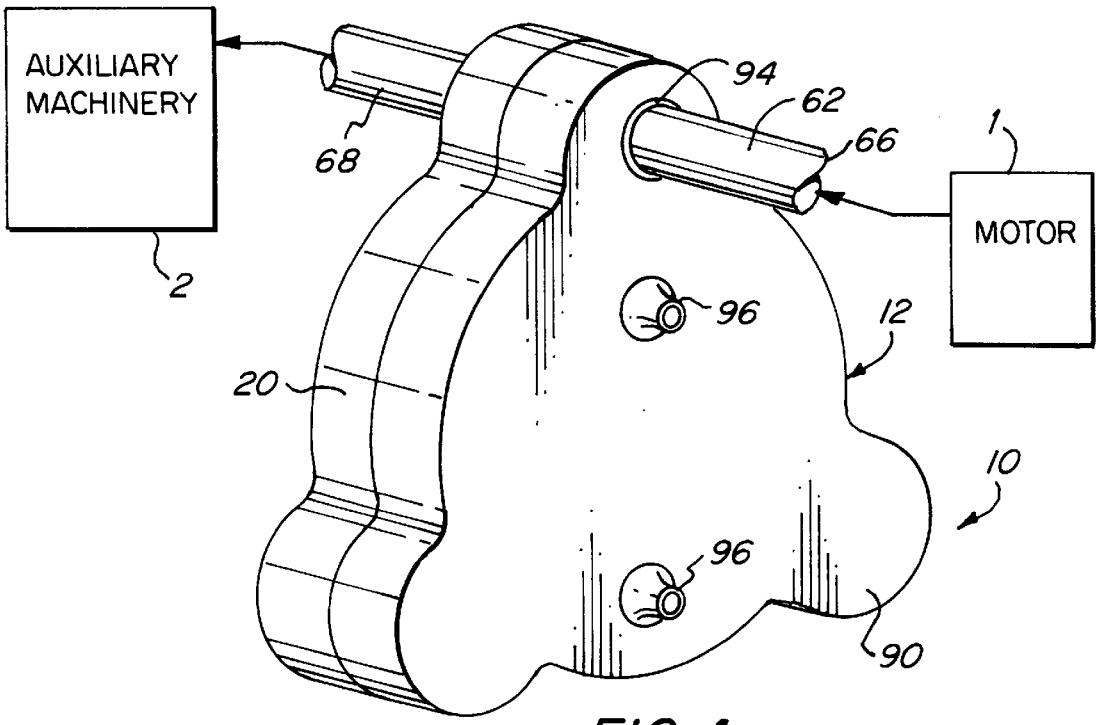
FIG. 1 is an isometric end view of a scroll compressor according to the present invention, with a shaft of a first eccentric crank mechanism of the compressor extending between schematic representations of a motor and an auxiliary machine.

Referring to FIGS. 1 through 4, the present invention provides a scroll compressor 10 including scroll members 20, 40 having involutes 22, 42 that mesh to define suction zones at an outer periphery of the scroll members, fluid voids between the scroll members that become smaller closer to the center of the scroll members, and an exhaust port 23 at the center of the scroll members. The scroll members 20, 40 orbit with respect to one another to suck fluid through the suction zones, compress the fluid through the shrinking fluid voids and expelled the compressed fluid through the exhaust port 23 under pressure.

The compressor 10 is provided with an eccentric crank mechanism 60 for retaining the scroll members 20, 40 in their orbiting relationship. The crank mechanism 60 includes a shaft 62 rotatably mounted in a housing 12 of the compressor 10, and an eccentric portion 64 fixed to the shaft in an offset axial alignment. In the embodiment shown, one of the scroll members 20 is fixed, while the other scroll member 40 is operatively connected to the shaft 62 through the eccentric portion 64 such that the crank mechanism 60 orbits the other, or orbiting, scroll member 40 about the fixed scroll member 20. It should be understood, however, that a compressor according to the present invention could include combinations of orbiting and fixed scroll members such as, for example, two orbiting scroll members, or two orbiting scroll members and one fixed scroll member, or two fixed scroll members and one orbiting scroll member, and so on.

Unlike conventional eccentric crank mechanisms, the shaft 62 of the eccentric crank mechanism 62 according to the present invention is elongated and extends through the compressor housing 12 and has a first end 66 for connection to a motor 1 and a second end 68 for connection to an auxiliary machine 2. Because the shaft 62 is connected directly to the motor 1, the eccentric crank mechanism 60 transmits rotational power to the scroll members 20, 40 while also retaining the scroll members in their orbiting relationship. Consequently, a separate input or drive shaft is not required by the compressor 10, such that the overall number of parts and complexity of the compressor is reduced. In addition, since the shaft 62 is also connected to an auxiliary machine 2, such as a hydraulic pump, a fan or another compressor stage for example, any excess power from the motor 1 is directly harnessed, without transmitting additional stresses through the scroll members 20, 40 or the housing 12 of the compressor 10.

The scroll compressor 10 preferably also includes at least one eccentric guide 70 for assisting the crank mechanism 60 in maintaining the scroll members 20, 40 in an orbiting relationship. As shown, the eccentric guide is provided in the form of a second eccentric crank mechanism 70 having a shaft 72 rotatably mounted to the compressor housing 12, and an eccentric portion 74 fixed to the shaft in an offset axial alignment. The orbiting scroll member 40 is also operatively mounted on the eccentric portion 74 of the second crank mechanism 70. It should be noted, however, that the eccentric guide 70 could take forms other than an eccentric crank mechanism. For example, the eccentric guide could comprise a slide guide on the housing and a slider on the first scroll member received in the slide guide to restrict the orbiting scroll member to an orbiting motion. Such a slider and slide guide are disclosed for example in U.S. Pat. No. 5,165,878 to Inagaki et al. In addition, the eccentric guide could comprise an idler crank assembly as disclosed in U.S. Pat. No. 5,466,134 to Shaffer et al.

Figure 2:
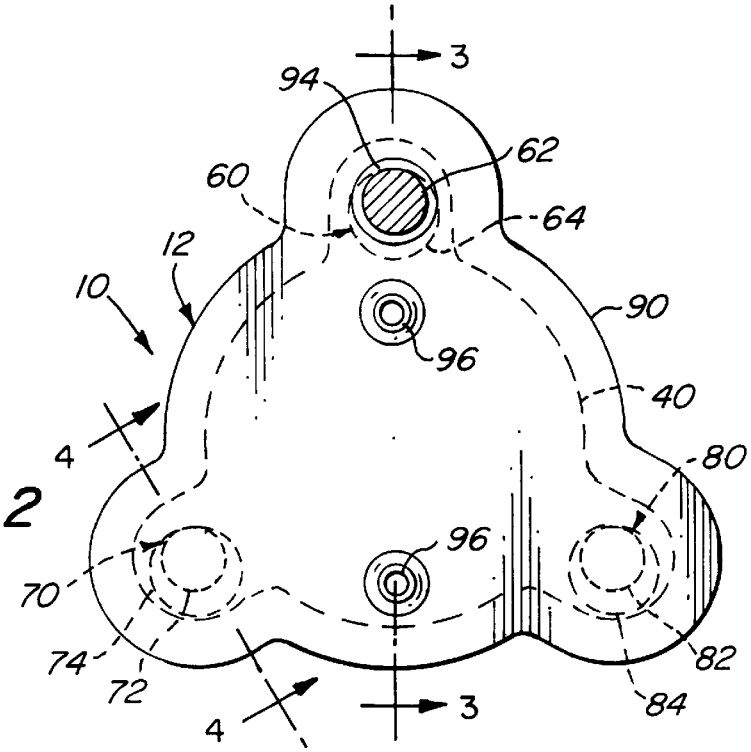
FIG. 2 is an elevational end view of the scroll compressor of FIG. 1.
Figure 3:
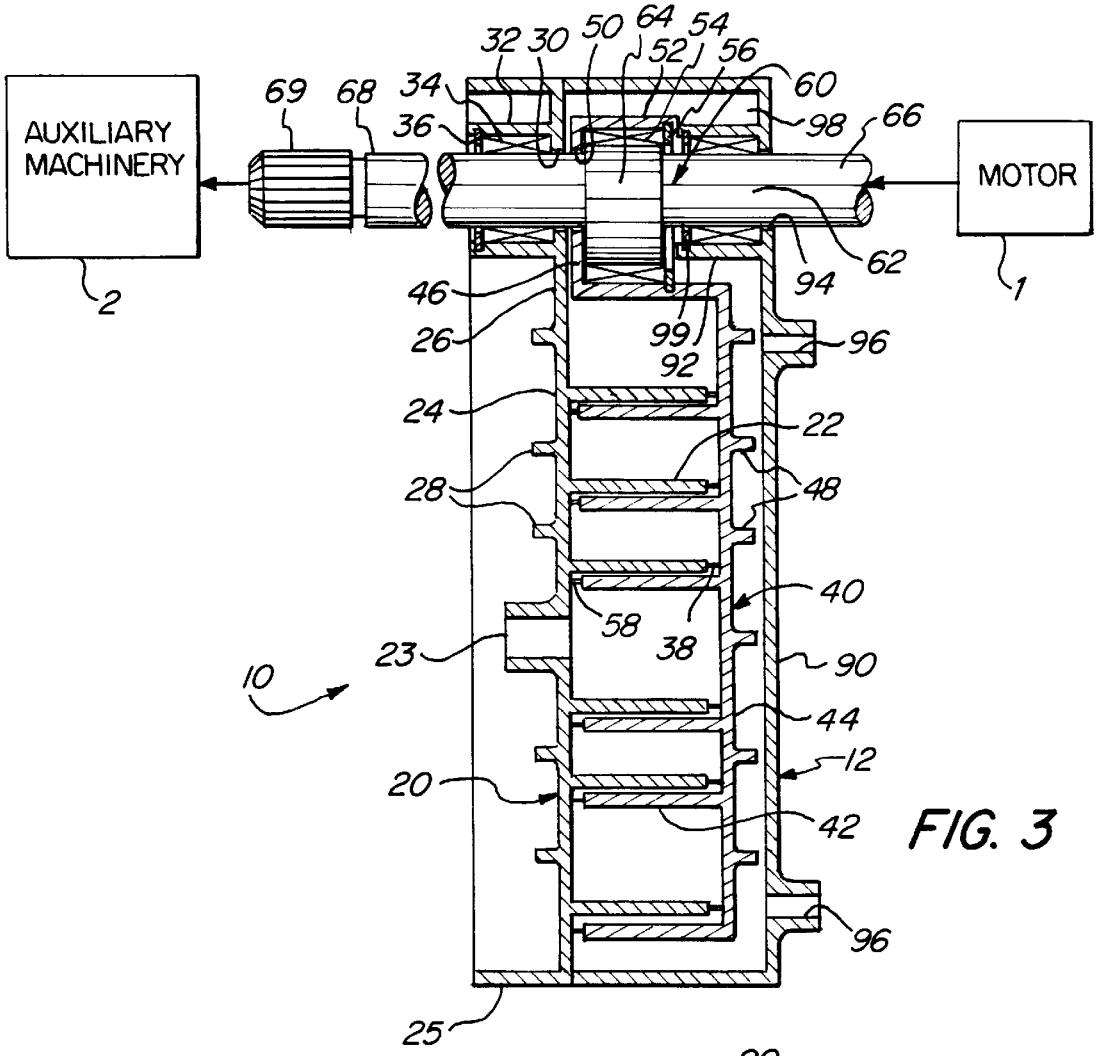
FIG. 3 is an enlarged, cross-sectional view of the scroll compressor of FIG. 1 taken along 3—3 in FIG. 2 showing the first eccentric crank mechanism.
Figure 4:
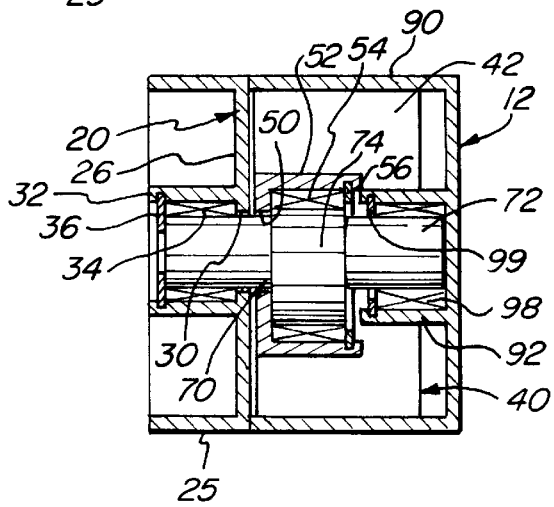
FIG. 4 is an enlarged, cross-sectional view of the scroll compressor of FIG. 1 taken along 4—4 in FIG. 2 showing a second eccentric crank mechanism.

As shown in FIG. 2, the scroll compressor includes a third eccentric crank mechanism 80 having a shaft 82 rotatably mounted to the housing 12 and an eccentric portion 84 fixed to the shaft in an offset axial alignment, with the orbiting scroll member 40 operatively mounted on the eccentric portion. In the embodiment shown, the shafts and eccentric portions of each crank mechanism are a unitary piece. Alternatively, however, the eccentric portions could be separated from the shafts and fixed to the shafts with set screws, for example. In addition, the second end 68 of the shaft 62 of the first crank mechanism 60 can be provided with a coupling 69, for connection to the auxiliary machine 2. Although not shown, the first end 66 of the shaft 62 could similarly be provided with a coupling.

As shown, the three eccentric crank mechanisms 60, 70, 80 are positioned at the outer periphery of the scroll members 20, 40 as opposed to being positioned at a center of the scroll members. In this way, the crank mechanisms 60, 70, 80 do not interfere with the centrally located exhaust port 23 on the fixed scroll member 20, or the placement of strengthening/heat dissipating ribs 28, 48 on both scroll members 20, 40, respectively.

It should be noted that, although the three eccentric crank mechanisms 60, 70, 80 are shown having shafts 62, 72, 82 of the same thickness, the first eccentric crank mechanism 60 could be provided with a much larger shaft. For example, the compressor could itself comprise an auxiliary machine siphoning power off a large shaft connected between a motor and a primary machine. In such a case, the first eccentric crank mechanism 60 would have a much larger shaft, and the eccentric portions 64, 74, 84 would then be appropriately sized to accommodate the different sized shafts.

Each scroll member 20, 40 includes a generally circular plate 24, 44 having three equally spaced apart, generally triangular ears 26, 46, respectively. The fixed scroll member 20 also includes a sidewall 25 extending outboardly from the outer periphery of the plate 24. The ears 26 of the fixed scroll member 20 each include a bore 30 and a sleeve 32 axially aligned with the bore. Bearings 34 are received in the sleeves 32 and retained with c-rings 36, and the shafts 62, 72, 82 of the crank mechanisms 60, 70, 80 extend through the bores and are received in the bearings, such that the bearings allow the shafts to rotate about their axes. The ears 46 of the orbiting scroll member 40 each include a bore 50, and a sleeve 52 axially aligned with the bore. Bearings 54 are received in the sleeves and retained with c-rings 56. The bearings 54 of the orbiting scroll member 40, however, receive the eccentric portions 64, 74, 84 of the crank mechanisms 60, 70, 80 such that the eccentric portions are free to rotate with the shafts 62, 72, 82.

The involutes 22, 42 of each scroll member 20, 40 extend inboardly, while the strengthening/heat dissipating ribs 28, 48 extend outboardly. The involutes 22, 42 are sized such that the involute of one scroll member extends nearly to the plate of the opposing scroll member. The compressor 10 may also be provided with seals 38, 58 on the involutes 22, 42 for sealing any clearance or "blow hole" between one involute and its opposing plate. The details of the involutes are not described here in further detail since their operation is known to those skilled in the art. Generally, however, the involutes 22, 42 mesh to define the suction zones at the outer periphery of the scroll members 20, 40 and the fluid voids between the scroll members that become smaller closer to the center of the scroll members. As the orbiting scroll member 40 is orbited about the fixed scroll member 20, fluid is sucked between the scroll members through the suction zones, compressed through the shrinking fluid voids and expelled through the exhaust port 23 under pressure.

The compressor housing 12 is comprised of the fixed scroll member 20 and a cover 90 secured to the fixed scroll member and containing the orbiting scroll member 40. The cover 90 defines three inboardly extending sleeves 92. Bearings 98 are received in the sleeves and retained with c-rings 99, and the shafts 62, 72, 82 of the crank mechanisms 60, 70, 80 are received in the bearings. The cover 90 also includes a bore 94 aligned with the sleeve 92 associated with the first crank mechanism 60 so that the shaft 62 of the first crank mechanism can extend out of the housing 12 through the cover. The cover 90 further includes two fill ports 96 for providing fluid to the suction zones of the scroll members 20, 40.

Figure 5:
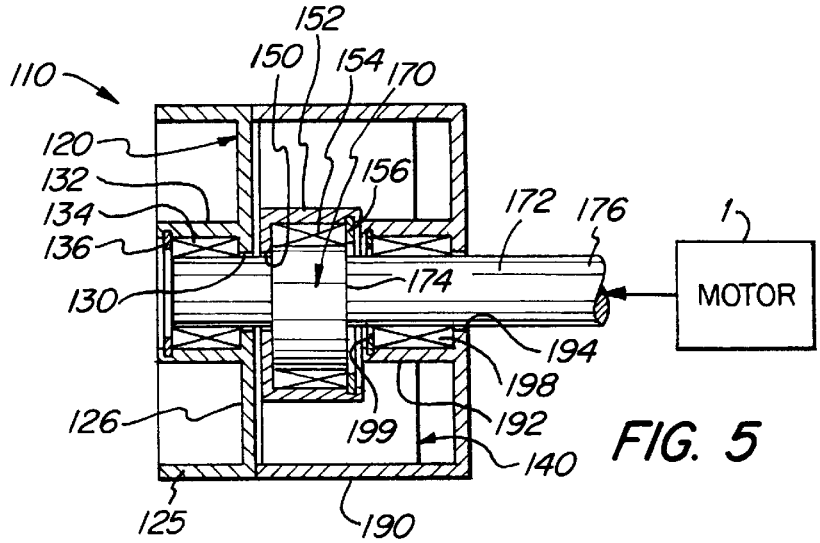
FIG. 5 is a cross-sectional view similar to FIG. 4 of another scroll compressor according to the present invention, with a shaft of a second eccentric crank mechanism extending to a schematic representation of a motor.

Another scroll compressor 110 according to the present invention is shown in FIG. 5. The compressor 110 is similar to the compressor 10 of FIGS. 1 through 4, and elements that are the same have the same reference numeral preceded by a "1". The compressor 110 includes a second eccentric crank mechanism 170 having an elongated shaft 172 with a first end 176 extending out of the compressor housing 112, through a bore 194, for connection to a motor 1. The motor 1 can be the same motor 1 connected to the elongated shaft of the first eccentric crank mechanism, or could be a separate motor.

The present invention, therefore, allows the use of multiply driveshafts within the compressor in order to increase the efficiency of the compressor and to more evenly distribute stresses acting on the compressor and, in particular, the scroll members. Moreover, since the shafts include the eccentric portions, the number of driveshafts can be increased without making the compressor overly complex. Although not shown, it should be noted that the third eccentric crank mechanism could also be provided with an elongated shaft for connection to the motor. In addition, the compressor could be configured with more than three crank mechanisms, with each crank mechanism having an elongated shaft for connection to a motor. The ability to use multiple motors could be beneficial, for example, if it was determined that using three 1 hp motors would be less expensive or provide smaller packaging than using a single 3 hp motor for a particular application. Furthermore, motors and auxiliary machines can be mounted on either or both sides of the compressor.

Figure 6:
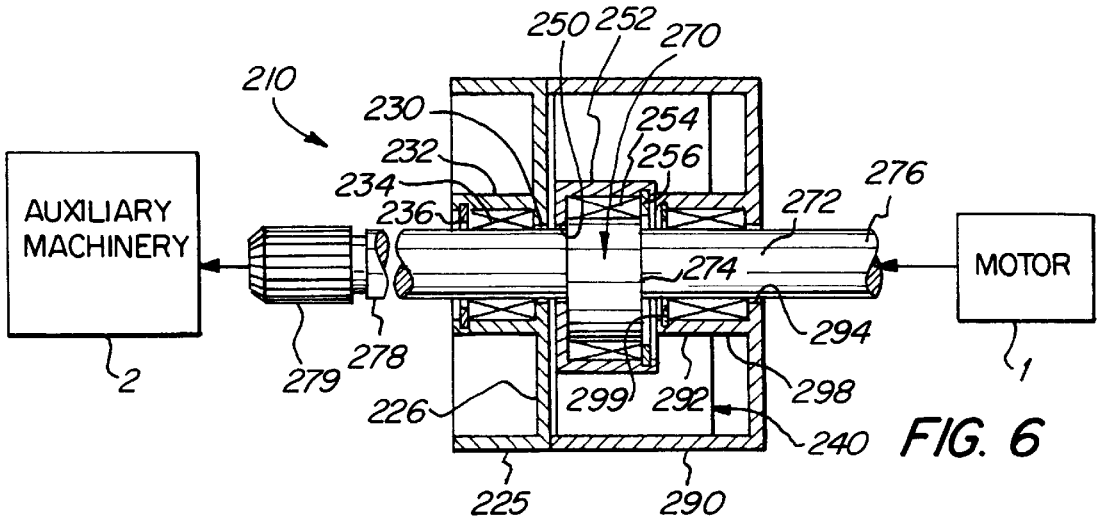
FIG. 6 is a cross-sectional view similar to FIG. 4 of an additional scroll compressor according to the present invention, with a shaft of a second eccentric crank mechanism extending between schematic representations of a motor and an auxiliary machine.

An additional scroll compressor 210 according to the present invention is shown in FIG. 6. The compressor 210 is similar to the compressor 10 of FIGS. 1 through 4, and elements that are the same have the same reference numeral preceded by a "2". The compressor 210 includes a second eccentric crank mechanism 270 having an elongated shaft 272 with a first end 276 extending out of the compressor housing 212, through a bore 294, for connection to a motor 1, and a second end 278 extending out of the compressor housing for connection to an auxiliary machine 2. The auxiliary machine 2 can be the same machine 2 connected to the second end of the elongated shaft of the first eccentric crank mechanism, or could be a separate auxiliary machine. Although not shown, it should be noted that the third eccentric crank mechanism could also be provided with an elongated shaft for connection to a motor and an auxiliary machine. In addition, the compressor could be configured with more than three crank mechanisms, with each crank mechanism having an elongated shaft for connection to a motor and an auxiliary machine.

Figure 7:
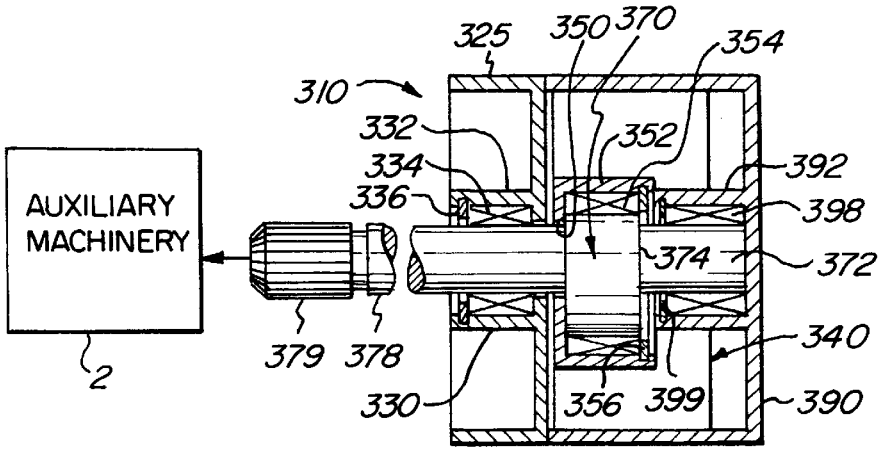
FIG. 7 is a cross-sectional view similar to FIG. 4 of a further scroll compressor according to the present invention, with a shaft of a second eccentric crank mechanism extending to a schematic representation of an auxiliary machine.

A further scroll compressor 310 according to the present invention is shown in FIG. 7. The compressor 310 is similar to the compressor 10 of FIGS. 1 through 4, and elements that are the same have the same reference numeral preceded by a "3". The compressor 310 includes a second eccentric crank mechanism 370 having an elongated shaft 372 with a second end 378 extending out of the compressor housing 312 for connection to an auxiliary machine 2. The auxiliary machine 2 can be the same machine 2 connected to the second end of the elongated shaft of the first eccentric crank mechanism, or could be a separate auxiliary machine. Although not shown, it should be noted that the third eccentric crank mechanism could also be provided with an elongated shaft for connection to an auxiliary machine. In addition, the compressor could be configured with more than three crank mechanisms, with each crank mechanism having an elongated shaft for connection to an auxiliary machine.

It should be noted that while the present invention is shown and described as applied to a scroll compressor, the present invention is also for use with other fluid displacement apparatus, such as vacuum pumps, air motors, expanders, and the like.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A scroll-type fluid displacement apparatus comprising:

a motor;

an auxiliary machine;

at least two scroll members; and an eccentric crank mechanism positioned at outer peripheries of the scroll members, said crank mechanism comprising, an elongated shaft connectable at one end to the motor and at another end to the machine, and an eccentric portion fixed to the elongated shaft and rotatably received by one of the scroll members so that the scroll members will orbit with respect to one another as the shaft is turned by the motor.

2. A scroll-type fluid displacement apparatus according to claim 1 wherein each scroll member include ribs.

3. A scroll-type fluid displacement apparatus according to claim 2 further comprising at least one eccentric guide for assisting the eccentric crank mechanism in retaining the scroll members in an orbiting relationship.

4. A scroll-type fluid displacement apparatus according to claim 3 wherein the eccentric guide comprises a second eccentric crank mechanism having a shaft and an eccentric portion fixed to the shaft and rotatably received by one of the scroll members.

5. A scroll-type fluid displacement apparatus according to claim 4 wherein the shaft of the second eccentric crank mechanism is connectable at one end to a machine.

6. A scroll-type fluid displacement apparatus according to claim 3 wherein the eccentric crank mechanisms are positioned at outer peripheries of the scroll members.

7. A scroll-type fluid displacement apparatus according to claim 3 wherein the shaft of the second eccentric crank mechanism is connectable at one end to a motor.

8. A scroll-type fluid displacement apparatus according to claim 1 wherein the shaft of the second eccentric crank mechanism is connectable at another end to a machine.

9. A scroll-type fluid displacement apparatus comprising:

a motor;

an auxiliary machine;

a fixed scroll member having a spiral involute and a centrally defined exhaust port;

an orbiting scroll member having a spiral involute meshed with the involute of the fixed scroll member to define fluid voids between the scroll members that become smaller towards the center of the scroll members;

a housing containing the scroll members; and an eccentric crank mechanism positioned at outer peripheries of the scroll members and having an elongated shaft and an eccentric portion fixed to the shaft in offset axial alignment, the shaft being mounted to the housing such that the shaft is able to freely rotate about its axis, the shaft extending through the housing for connection at a first end to the motor and connection at a second end to the auxiliary machine, with the eccentric portion received by the orbiting scroll member such that the eccentric portion can rotate with the shaft, whereby the orbiting scroll member will orbit with respect to the fixed scroll member when the shaft is rotated.

10. A scroll-type fluid displacement apparatus according to claim 9 further comprising a third eccentric crank mechanism having a shaft with an eccentric portion, said shaft being mounted to the housing such that the shaft is able to freely rotate about its axis, with said eccentric portion being received by the orbiting scroll member such that said eccentric portion can rotate with said shaft.

11. A scroll-type fluid displacement apparatus according to claim 10 further comprising a second eccentric crank mechanism having a shaft and an eccentric portion fixed to the shaft, said shaft being mounted to the housing such that the shaft is able to freely rotate about its axis, with said eccentric portion being received by the orbiting scroll member such that said eccentric portion can rotate with said shaft.

12. A scroll-type fluid displacement apparatus according to claim 11 wherein the shaft of the second eccentric crank mechanism has an end extending out of the housing for connection to a machine.

13. A scroll-type fluid displacement apparatus according to claim 10 wherein the shaft of the second eccentric crank mechanism has a first end extending out of the housing for connection to a motor.

14. A scroll-type fluid displacement apparatus according to claim 9 wherein the shaft of the second eccentric crank mechanism has a second end extending out of the housing for connection to a machine.

15. A scroll compressor comprising:

a motor;

an auxiliary machine;

a compressor housing;

a first scroll member contained within the housing and having a plate and a spiral involute extending from the plate;

a second scroll member contained within the housing and having a plate and a spiral involute extending from the plate, the spiral involutes of the first and second scroll members meshing to define fluid voids between the scroll members that become smaller towards the center of the scroll members;

a first shaft extending from the motor, through outer peripheries of the scroll members and out of the housing to the auxiliary machine, the first shaft mounted to the housing such that said shaft rotates about its own axis;

an eccentric portion fixed to the first shaft within said housing, said eccentric portion having an axis in offset axial alignment with the axis of said shaft;

a second shaft extending through outer peripheries of the scroll members and mounted to the housing such that the second shaft rotates about its own axis; and an eccentric portion fixed to the second shaft within said housing, said eccentric portion having an axis in offset axial alignment with the axis of the second shaft;

the first scroll member receiving the eccentric portions such that the eccentric portions can rotate with the shaft, whereby the first scroll member will orbit with respect to the second scroll member when the first shaft is rotated by the motor.

16. A scroll compressor according to claim 15 wherein the second shaft extends out of the housing.

17. A scroll compressor according to claim 16 wherein the second shaft extends from the motor.

18. A scroll compressor according to claim 15 wherein the second shaft extends out of the housing.

* * * * *